United States Patent [19]

Oellig et al.

[11] Patent Number: 4,509,864

[45] Date of Patent: Apr. 9, 1985

[54] PROGRAM PLATE FOR A TIMER

[75] Inventors: Oskar Oellig, Nuremberg; Horst Grimmer, Nuremberg-Oberasbach; Alfred-Günther Lunz, Nuremberg, all of Fed. Rep. of Germany

[73] Assignee: Diehl GmbH & Co., Nuremberg, Fed. Rep. of Germany

[21] Appl. No.: 629,276

[22] Filed: Jul. 10, 1984

[30] Foreign Application Priority Data

Jul. 15, 1983 [DE] Fed. Rep. of Germany ..... 3325588

[51] Int. Cl.[3] ..... H01H 43/10; G04F 8/00

[52] U.S. Cl. ..... 368/108; 200/38 D

[58] Field of Search ..... 368/9, 10, 107–113; 200/36, 37 R, 37 A, 38 R, 38 A, 38 FA, 38 FB, 38 B, 38 D, 38 PA

[56] References Cited

U.S. PATENT DOCUMENTS 2,736,377 2/1956 Everard ..... 200/38 DA 3,864,539 2/1975 Hauser ..... 200/38 DA 3,925,629 12/1975 Albinger, Jr. ..... 200/38 FB 3,930,359 1/1976 Flumm et al. ..... 368/108

*Primary Examiner*—Vit W. Miska

*Attorney, Agent, or Firm*—Scully, Scott, Murphy & Presser

[57] ABSTRACT

A program plate for a timer with setting means preferably arranged about the circumference of the program plate for the determination of a switching program, wherein the program plate is rotatably connected with a clockwork drive mechanism for operation of the program plate. An additional time display is operable through a further drive mechanism, which evidences a higher timewise resolution than the program plate, and which is integrated into the program plate. Within the circumferential surface area of the program plate, there is rotatably supported a preferably centrally positioned display disc for the higher resolved or defined time display, in which the further drive is supported within the program plate, and wherein the display disc is actuated by the further drive by means of the differential speed between the program plate and a housing component of the clockwork mechanism.

9 Claims, 1 Drawing Figure

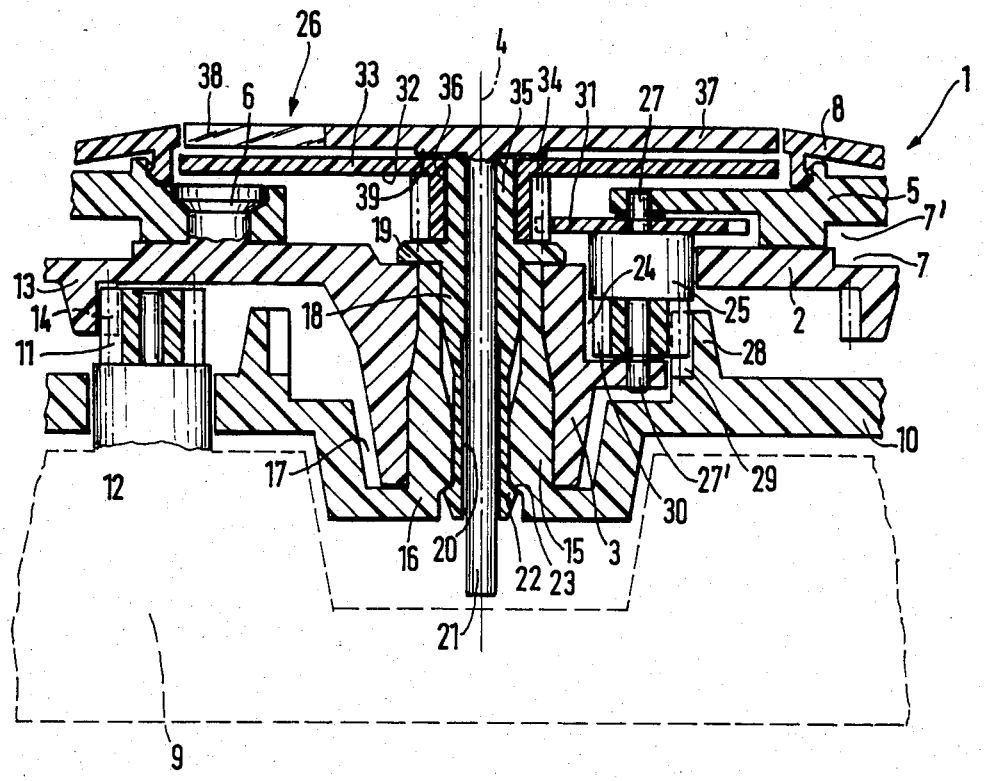
26
4
38
6
33
32
36
35
34
31
27
37
8
1
39
5
19
7'
7
13
24
14
18
25
2
11
28
10
12
17
27'
29
30
16
20
15
3
22
23
21
9

PROGRAM PLATE FOR A TIMER

BACKGROUND OF THE INVENTION

1. Field of the Invention

The present invention relates to a program plate for a timer with setting means preferably arranged about the circumference of the program plate for the determination of a switching program, wherein the program plate is rotatably connected with a clockwork drive mechanism for operation of the program plate, and an additional time display which is operable through a further drive mechanism, which evidences a higher timewise resolution than the program plate, and which is integrated into the program plate.

2. Discussion of the Prior Art

Program plates of the type described hereinabove are basically known in the state of the art. Thus, from the disclosure of German Published Patent Application No. 16 15 034 there can be ascertained a timer with a rotatable program plate into which there is integrated an additional time display in the form of a common numerical clock dial with hour and minute hands. The program plate incorporates undetachable slide contacts along its circumference, which are displaceable between two latching positions, and which are sensed by means of a cam with respect to their latching position (switching program). Thereby, one complete rotation of the program plate corresponds to a time interval of 24 hours, whereas the width of a slide contact corresponds to a time interval of 30 minutes (48 slide contacts). The program plate, as well as the hour and the minute hands are operated by means of three central, coaxially arranged axles by a clockwork mechanism, wherein an additional drive, or additional drive components (hereinbelow designated as a further drive) is necessary for the hour and minute hands inasmuch as the program plate effects only one rotation within 24 hours. Hereby, the program plate and the hands are mechanically coupled so that, for a set clock, there can be precisely maintained the switching points of the program plate.

However, any setting of that type of timer is then almost impossible through rotation of the switching plate since the additional drive mechanism with the coupled hour and minute coupled thereto must always be moved therewith. In a timer constructed pursuant to German Published Patent Application No. 16 15 034, there is accordingly provided a turnknob which is coupled with the minute hand, by means of which the time can be set. However, especially for timers which must be set frequently, for instance, socket plug timers, this is extremely cumbersome and time-consuming. Furthermore, the relatively complicated construction of the clockwork mechanism for the operation of three displays hands which rotate at different speeds necessitate a large constructional volume, while the construction, in general, is complicated and thereby more susceptible to breakdowns and is more expensive.

Furthermore, also known in the art are a large number of different kind of program plate constructions whose rotational speed for one rotation is constituted of either 24 hours or 7 days, and which do not incorporate any additional time display with a higher timewise resolution. Program plates of that type are, as a rule, directly rotatable by hand in a simple manner and also necessitate only a small-sized drive mechanism with a single drive output speed. Any precise setting to the currently actual time is, however, extremely difficult, in particular for weekly program plates, and partly completely impossible.

SUMMARY OF THE INVENTION

Accordingly, it is an object of the present invention to provide a program plate for a timer which, while maintaining the advantages of the state of the art, can be set simply and precisely to the actual time, and whose clockwork mechanism requires only a single drive output speed.

The foregoing object is achieved through the intermediary of a program plate as described hereinabove wherein, within the circumferential surface area of the program plate, there is rotatably supported a preferably centrally positioned display disc for the higher resolved or defined time display, in which the further drive is supported within the program plate, and wherein the display disc is actuated by the further drive by means of the differential speed between the program plate and a housing component of the clockwork mechanism.

A program plate of that type can be utilized, in an advantageous manner, in conjunction with a drive mechanism which will also operate a simple program plate without additional time display; in essence, in that there can be constructed a drive mechanism on which there can be selectively applied a program plate with or without an additional time display. This serves to provide for a significant reduction in manufacturing costs.

Thus, in an advantageous manner can there be reduced the technical requirements for the further drive mechanism. During the necessary resolution for the additional time display it is sufficient, at suitably dimensioned transitions, that the drive input pinion and the drive output gear are directly connected with each other.

Furthermore, it is possible to protect the display disc from dirt and touching through the use of a cover plate. Thereby, the cover plate can be secured against rotation with the program plate, or preferably secured against rotation relative to the housing of the clockwork mechanism. Thereby, the first possibility is advantageous when the direction of rotation of the display disc is directed opposite the direction of rotation of the program plate, inasmuch as thereby the relative speed between the two components and, as a result, the display precision will be increased; in essence, there is reduced the necessary translation for the drive of the display disc. The second possibility is utilized in an advantageous manner when the directions of rotation of the display disc and of the program plate are the same.

At the construction of the cover plate with a window or viewing aperture, there can advantageously be employed a (opaque) material which is optimal for the plate with regard to its mechanical properties.

BRIEF DESCRIPTION OF THE DRAWING

Further advantages of the invention and novel configurations may be ascertained from the following detailed description thereof, taken in conjunction with the single FIGURE of the accompanying drawing which illustrates a transverse sectional view through a preferred embodiment of a program plate with an additional time display.

DETAILED DESCRIPTION

In timers with program plates in which the setting or the presence of slide contacts is mechanically sensed, there is attained an extremely high degree of precision in switching. For program plates with undetachable slide contacts; for example; with a daily program plate having a diameter of about 6 cm, it is possible to have 96 slide contacts (15 minutes for each slide contact). The precision of switching hereby lies within less than plus or minus one minute. At corresponding weekly program plates, there are utilized 84 slide contacts (two hours for each slide contact), wherein the precision of switching lies within less than plus or minus ten minutes. This high switching precision, however, cannot be used as a rule since the precise setting to the actual time of day is only extremely difficult to achieve. The already previously described solutions to this problem through the integration of an additional complete clock display into the program plate, with a further drive mechanism which is mechanically coupled with the drive for the program plate, exhibits the above-mentioned various disadvantages. By means of the invention, in contrast therewith a complete clock there should be provided a clearly simplified additional time display, through which it is possible to effectuate a setting of the program plate to the actual time of day with a degree of precision which generally conforms with that of current switching precisions. Thereby, the program plate must be so coupled with the additional time display that upon a resetting of the program plate there is synchronously reset the additional time display.

Referring in detail to the drawing, there is essentially shown a transverse section through an essential circular program plate 1 of which the area in proximity of its circumference with the suitable slide contacts is not shown.

The program plate 1 is preferably constructed of multiple components. It consists of a plate carrier 2 with a preferably integrally formed tubular hub 3 which is located centrally thereof, and which is opened towards both ends, and in the direction of a rotary axle 4 for the hub 3 is constructed significantly thicker than the plate carrier 2. Fastened on the plate carrier 2 is an annular spring disc 5, preferably through the use of rivets 6. In the proximity with the circumference of the program plate 1, formed in the plate carrier 2 and in the spring disc 5 are recesses 7, 7' in the surfaces facing each other, which serve to receive suitable slide contacts (not shown). On the spring disc 5, a smaller scale ring 8 is raised from the surface thereof in the region of the recesses 7, 7' which; for instance, evidences legends for the identification of the slide contacts.

The program plate 1 is operated by a clockwork mechanism 9 which is located below the program plate 1, which is not shown in detail and which includes a housing 10 of which only the portion facing towards the program plate is illustrated in the drawing. The housing 10 of the clockwork mechanism 9 can also be constructed in a known manner, of correspondingly configured support plates. A drive output pinion 11 of the clockwork mechanism 9 which is arranged in parallel with the rotary axle 4, is guided in a cutout 12 of the housing 10 and projects outwardly beyond the housing 10 in a direction towards the program plate 1. The drive output pinion 11 engages with a gear ring 13, which is preferably integrally formed with the plate carrier 2, which has an internal toothing 14 and therewith drives the program plate 1.

The program plate 1 is supported by means of its hub 3 on a support sleeve 15 which is preferably integrally formed with the housing 10. The housing 10 is recessed hollow-like in the region of the base point 16 of the support sleeve 15 in a direction towards the clockwork mechanism 9. Thereby created hollow 17 serves for the receipt of a portion of the hub 3 in order to maintain the structural height of the entire arrangement as low as possible.

The support sleeve 15 preferably formed as a guide conduit which is open towards both ends thereof, and into which there can be inserted a latching or arresting bolt 18. The latching bolt includes a protuberance at its outer end which projects over the guide conduit so as to thereby form a security against any axial displacement of the hub 3 on the support sleeve 15. The latching bolt 18 is preferably provided with a central through-bore 20 which extends along the rotary axle 4, and which serves for the receiving of a securing pin 21. The latching bolt 18 is provided at its end towards the drive with radially located resilient projections 22 which, in the inserted condition of the latching bolt 18, engage behind a conical widening 23 opening in the direction towards the drive mechanism, at the inner diameter on the base point 16 of the guide conduit, and thereby retain the latching bolt 18 in a predetermined position. Through the insertion of this securing pin 21 into the latching bolt 18 there is restrained the resiliency of the projections 22 such that the latching bolt 18 can no longer be withdrawn from the guide conduit. For example, the resilience of the projections 22 is provided in that the end of the latching bolt 18 towards the drive end is slotted in an axial direction and thus, upon insertion into the slotted region, can be compressed. Through the insertion of the securing pin 21, compressing of the latching bolt 18 is no longer possible.

In a program plate 1 of that type there is inventively provided a cutout 24, preferably in the conformingly shaped plate carrier 2 and the spring disc 5, which serves for the receiving of a further drive mechanism 25 for the operation of an additional time display 26 which possesses a higher timewise resolution than the program plate 1. Hereby, the spring disc 5 and the plate carrier 2 evidence corresponding bearing locations 27, 27' for the further drive 25.

The further drive 25 is operated by means of the differential speed between the program plate 1 and a housing portion 28 of the housing 10, preferably by a ring gear 29 which is integrally formed on the housing 10 about the hollow 17, such that; for instance, a drive pinion 30 of the further drive mechanism 25 in the correspondingly shaped recess 24 in the program plate 1 is accessible from externally thereof, and which is in engagement with the ring gear 29 formed on the housing 10.

The further drive 25, through the intermediary of a drive output gear 31, drives a gear 34 which is fastened to the surface 32 of a display disc 33 at the drive side thereof, and which is preferably formed integrally therewith, and thereby drives the display disc 33. The display disc 33 is arranged centrally within the peripheral surface extension of the program plate 1, preferably within the scale ring 9, and can be supported in different ways. Preferably, (as illustrated in the drawing) the latching bolt 18 includes a tubular extension 35 externally thereof on the projection 19 in the direction towards the rotational axis 4 whose outer surface 36 forms a rotary bearing for the display disc 33 and the gear 34. Furthermore, it would also be possible to support the display disc 33 and the gear 34 on the correspondingly shaped securing pin 21.

The display disc 33 is protected relative to the outside of the program plate 1 by means of a cover plate 37 which is at the same height therewith and is located within the scale ring 8. The cover plate 37 is preferably integrally formed with the securing pin 21. Thereby, the cover plate can have an aperture or viewing window 38 provided therein, which incorporates a marking which cooperates with a time scale provided on the display disc 33, and which can be at least partially read off through the aperture 38. The cover plate 37 evidences at its transition into the securing pin 21 one or more projections 39 which provide the necessary spacing between the cover plate 37 and the display disc 33. The securing pin 21, together with the cover plate 37, in this embodiment, must be supported so as to be secured against rotation relative to the housing 10 of the clockwork mechanism 9. This can be effectuated with usual means; for example, with a protrusion (not shown) on the securing pin 21 which fits into a corresponding recess (also not shown) on the inside of the tubular extension 35 on the latching bolt 18. Naturally, the latching bolt 18 must then also be secured against rotation relative to the housing 10 which, for instance, can be achieved with the same means.

In a further preferred embodiment of a program plate 1 (not illustrated) the cover plate 37 can also be secured with the program plate 1 against rotation relative thereto. For example, the scale ring 18 can be integrally formed with the cover plate 37, which are commonly raised up on the spring disc 5. The securing pin 27 then ends below the cover plate and possesses a nailhead-shaped recess which projects over the tubular extension 35 of the latching bolt 18 and serves as a safety against any axial displacement of the display disc 33. In this case, the aperture 38 which is provided in the cover plate 37 additionally moves relative to display disc 33 at the rotational speed of the program plate 1.

The additional time display can be differently configured:

Thus, firstly, the display disc 33 can carry a time scale which cooperates with a marking, preferably in the aperture 38 of the cover plate 37. Secondly, the display disc 33 can carry one or more markings which cooperate with a time scale; for example, on the scale ring 8 or in the region of the aperture 38 in the cover plate 37.

Preferably, the additional time display 26 can be so designed that the display disc 33 will move during one hour over a fraction (for example $\frac{1}{8}$) of an entire rotation relative to the selected marking.

The timewise resolution is then sufficiently large in order to allow the program plate 1 to be meaningfully set to the actual time. Concurrently the translation which is necessary for the further drive 25 is reduced to such an extent that the drive pinion 30 and the drive output gear 31 can be connected directly with each other, and can be preferably integrally constructed.

What is claimed:

1. In a program plate for a timer including setting means arranged along the circumference of the program plate for the determination of a switching program, said program plate being rotatably connected with a clockwork drive mechanism for driving said program plate, and an additional time display operable by a further drive mechanism, said additional time display possessing a higher timewise resolution than the program plate, and said further time display being integrated into the program plate; the improvement comprising a display disc centrally located and rotatably supported within the peripheral surface extent of the program plate for the higher resolved additional time display; said further drive mechanism being supported in the program plate; and the display disc being operated through the differential speed between the program plate and a housing portion of the clockwork drive mechanism by said further drive mechanism.

2. Program plate as claimed in claim 1, including a recess in the program plate, said recess including bearing locations for said further drive mechanism which is arranged in parallel with a rotational axis of the program plate.

3. Program plate as claimed in claim 2, wherein said recess includes an opening providing access to a drive pinion of said further drive mechanism from externally of the program plate.

4. Program plate as claimed in claim 3, wherein the housing of the clockwork drive mechanism includes a ring gear on a surface thereof facing towards the program plate, said ring gear including an internal toothing in operative engagement with the drive pinion.

5. Program plate as claimed in claim 1, wherein a drive gear is provided on the display disc on the surface facing towards the drive mechanism, said drive gear being in engagement with a drive output gear of said further drive mechanism.

6. Program plate as claimed in claim 5, wherein the drive gear and the drive output gear are secured together against rotation, and are of a unitary structure.

7. Program plate as claimed in claim 1, wherein a cover plate covers the display disc towards the exterior of the program plate, said cover plate being secured against rotation relative to the housing of the clockwork drive mechanism.

8. Program plate as claimed in claim 1, wherein a cover plate covers the display disc as a protection towards the exterior of the program plate, the cover plate being secured against rotation relative to the program plate.

9. Program plate as claimed in claim 7, wherein the cover plate is opaque, and an aperture being provided in the cover plate through which at least a portion of the display disc is viewable from externally of the program plate.

* * * * *